US011986716B2

(12) United States Patent
Yee

(10) Patent No.: US 11,986,716 B2
(45) Date of Patent: May 21, 2024

(54) PERSONAL YOGA EQUIPMENT STORAGE SYSTEM AND METHOD

(71) Applicant: Evan Yee, Brooklyn, NY (US)

(72) Inventor: Evan Yee, Brooklyn, NY (US)

( * ) Notice: Subject to any disclaimer, the term of this patent is extended or adjusted under 35 U.S.C. 154(b) by 279 days.

(21) Appl. No.: 17/140,012

(22) Filed: Jan. 1, 2021

(65) Prior Publication Data

US 2022/0212084 A1 Jul. 7, 2022

(51) Int. Cl.
*A63B 71/00* (2006.01)
*A63B 21/00* (2006.01)

(52) U.S. Cl.
CPC ..... *A63B 71/0036* (2013.01); *A63B 21/4037* (2015.10); *A63B 2210/50* (2013.01)

(58) Field of Classification Search
CPC .. A45F 2003/003; A45F 3/02; A63B 71/0036; A63B 21/4037; A63B 2210/50; A63B 23/0458; A63B 2225/685; A63B 15/00; A63B 2009/08; A63B 2225/68
USPC ..... 206/494, 315.1
See application file for complete search history.

(56) References Cited

U.S. PATENT DOCUMENTS 3,197,062 A * 7/1965 Day ..... B65D 5/0005 206/451
3,284,819 A * 11/1966 Nissen ..... A63C 19/04 404/35
6,971,542 B2 * 12/2005 Vogel ..... B65H 45/24 221/45
7,318,794 B2 * 1/2008 Davies ..... A63B 21/00047 482/142
8,029,426 B2 * 10/2011 Sohn ..... A63B 21/4037 482/145
8,510,878 B2 * 8/2013 Wang ..... A47G 27/0237 5/419
10,350,449 B2 * 7/2019 Abrahams ..... A63B 71/0036
D887,505 S * 6/2020 Tumpson ..... D21/686
10,894,197 B2 * 1/2021 Searcy ..... A45C 15/00
11,534,653 B2 * 12/2022 Constantz ..... A63B 21/4037
2008/0118671 A1 * 5/2008 Bienkiewicz ..... A63B 21/4037 428/12
2015/0014205 A1 * 1/2015 Yap ..... B65D 83/0805 206/494
2015/0258363 A1 * 9/2015 Kampinski ..... A63B 21/00047 482/139
2015/0298895 A1 * 10/2015 Corbett ..... B65D 85/08 53/467
2016/0129299 A1 * 5/2016 Newman ..... A63B 21/4037 482/142
2021/0113886 A1 * 4/2021 Van Curen ..... A63B 6/00
2021/0275857 A1 * 9/2021 Christ ..... A63B 21/4037
2021/0353997 A1 * 11/2021 Gupta ..... A63B 21/4037
2022/0212084 A1 * 7/2022 Yee ..... A63B 21/4037

* cited by examiner

*Primary Examiner* — Chun Hoi Cheung

(57) ABSTRACT

A system and method for personal yoga equipment storage includes a yoga mat folded by a first length, at least a first width, and accordion folded; a first yoga block configured to enclose a first part of the accordion-folded yoga mat; a second yoga block configured to enclose a second part of the accordion-folded yoga mat; and a strap configured to wrap the enclosed accordion-folded yoga mat by surrounding a perimeter of the first and second yoga blocks and conceal the accordion-folded yoga mat.

19 Claims, 9 Drawing Sheets

PERSONAL YOGA EQUIPMENT STORAGE SYSTEM AND METHOD

CROSS REFERENCE TO RELATED APPLICATIONS

This application is a nonprovisional application based on a provisional application No. 62/956,308, filed on Jan. 1, 2020.

BACKGROUND

Yoga, as we know it today, began over 5,000 years ago in Northern India. Many types of yoga developed over the years. Although there are many types of yoga, the individual practice of yoga requires equipment. Typical equipment includes a yoga mat, a yoga block and some form of strap.

A person interested in attending yoga classes typically brings a personal yoga mat, typically rolled and carried by the person attending classes. What is needed is a better system and method to carry typical equipment in an elegant and efficient manner.

SUMMARY

A system and method for personal yoga equipment storage includes a yoga mat folded by a first length, at least a first width, and accordion folded; a first yoga block configured to enclose a first part of the accordion-folded yoga mat; a second yoga block configured to enclose a second part of the accordion-folded yoga mat; and a strap configured to wrap the enclosed accordion-folded yoga mat by surrounding a perimeter of the first and second yoga blocks and conceal the accordion-folded yoga mat.

In one or more embodiments, the strap includes at least one buckle, the at least one buckle on a side of the first or second yoga block.

In one or more embodiments, the first yoga block and the second yoga block include a first plastic injection-molded outer sleeve coupled to the first yoga block; and a second plastic injection-molded outer sleeve coupled to the second yoga block, wherein each of the first plastic injection-molded outer sleeve and the second plastic injection-molded outer sleeves include a plurality of magnets embedded therein; a first polyurethane foam outer cap coupled to the first plastic injection-molded outer sleeve; and a second polyurethane foam outer cap coupled to the second plastic injection-molded outer sleeve, wherein each of the first and second polyurethane foam outer caps identify a location of the plurality of magnets.

In one or more embodiments, the first yoga block and the second yoga block are comprised of ethylene-vinyl acetate (EVA).

In one or more embodiments, the first and second polyurethane foam outer caps are comprised of ethylene-vinyl acetate (EVA).

In one or more embodiments, the strap further includes at least one thermoplastic polyurethane strip configured to prevent the sliding of the at least one buckle past a predetermined area of the strap.

In one or more embodiments, the strap further comprises: at least one metal plate configured to correspond to at least one of the pluralities of magnets embedded on the first plastic injection-molded outer sleeve and the second plastic injection-molded outer sleeve.

In one or more embodiments, the at least one metal plate is comprised of steel.

In one or more embodiments, the strap further includes a double D-shaped ring at a first end of the strap to enable a second end of the strap to secure a combination of the first yoga block and the second yoga block and the accordion-folded yoga mat.

Another embodiment is directed to a method for storing personal yoga equipment, the method including folding a yoga mat lengthwise at least once to reduce a width of the yoga mat; accordion-folding the reduced-width yoga mat; enclosing a first part of the accordion-folded yoga mat with a first yoga block; enclosing a second part of the accordion-folded yoga mat with a second yoga block; and surrounding a perimeter of the first and second yoga blocks with a strap configured to wrap and conceal the enclosed accordion-folded yoga mat.

In one or more embodiments of the method, the strap further at least one buckle, the at least one buckle disposed on a side of the first or second yoga block.

In one or more embodiments, the first yoga block and the second yoga block include a first plastic injection-molded outer sleeve coupled to the first yoga block; and a second plastic injection-molded outer sleeve coupled to the second yoga block, wherein each of the first plastic injection-molded outer sleeve and the second plastic injection-molded outer sleeves include a plurality of magnets embedded therein; and a first polyurethane foam outer cap coupled to the first plastic injection-molded outer sleeve; and a second polyurethane foam outer cap coupled to the second plastic injection-molded outer sleeve, wherein each of the first and second polyurethane foam outer caps identify a location of the plurality of magnets.

In one or more embodiments of the method, the first yoga block and the second yoga block are comprised of ethylene-vinyl acetate (EVA).

In one or more embodiments, the first and second polyurethane foam outer caps are comprised of ethylene-vinyl acetate (EVA).

In one or more embodiment of the method, the strap further includes at least one thermoplastic polyurethane strip configured to prevent the sliding of the at least one buckle past a predetermined area of the strap.

In one or more embodiments, the strap further includes at least one metal plate configured to correspond to at least one of the pluralities of magnets embedded on the first plastic injection-molded outer sleeve and the second plastic injection-molded outer sleeve.

In one or more embodiments of the method, the at least one metal plate is comprised of steel.

In one or more embodiments of the method, the strap further includes a double D-shaped ring at a first end of the strap to enable a second end of the strap to secure a combination of the first yoga block and the second yoga block and the accordion-folded yoga mat.

In one or more embodiments of the method, the at least one metal plate is disposed near the double D-shaped ring to enable a magnetic coupling of the at least one metal plate with one or more of the pluralities of magnets embedded on the first plastic injection-molded outer sleeve and the second plastic injection-molded outer sleeve.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
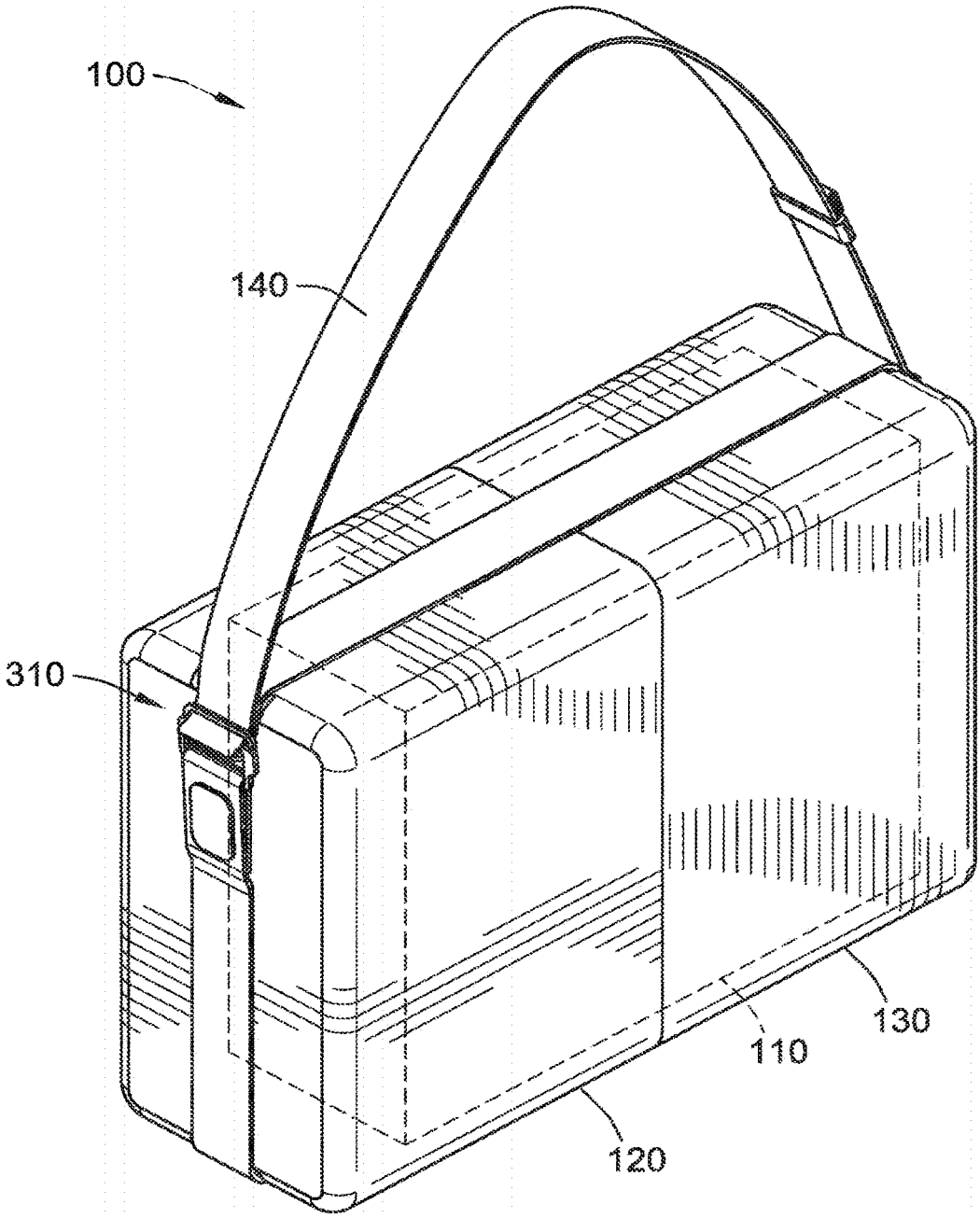
FIG. 1 is a perspective view of a yoga equipment storage system in accordance with one or more embodiments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring now to FIG. 1, a system and method for personal yoga equipment storage 100 includes a yoga mat 110 folded by a first length, at least a first width, and accordion folded.

FIG. 1 further shows a first yoga block 120 configured to enclose a first part of the accordion-folded yoga mat 110; a second yoga block 130 configured to enclose a second part of the accordion-folded yoga mat 110; and a strap 140 configured to wrap the enclosed accordion-folded yoga mat by surrounding a perimeter of the first and second yoga blocks 120 and 130 and conceal the accordion-folded yoga mat 110. Also shown is a buckle system 310, further described below.

Figure 2A:
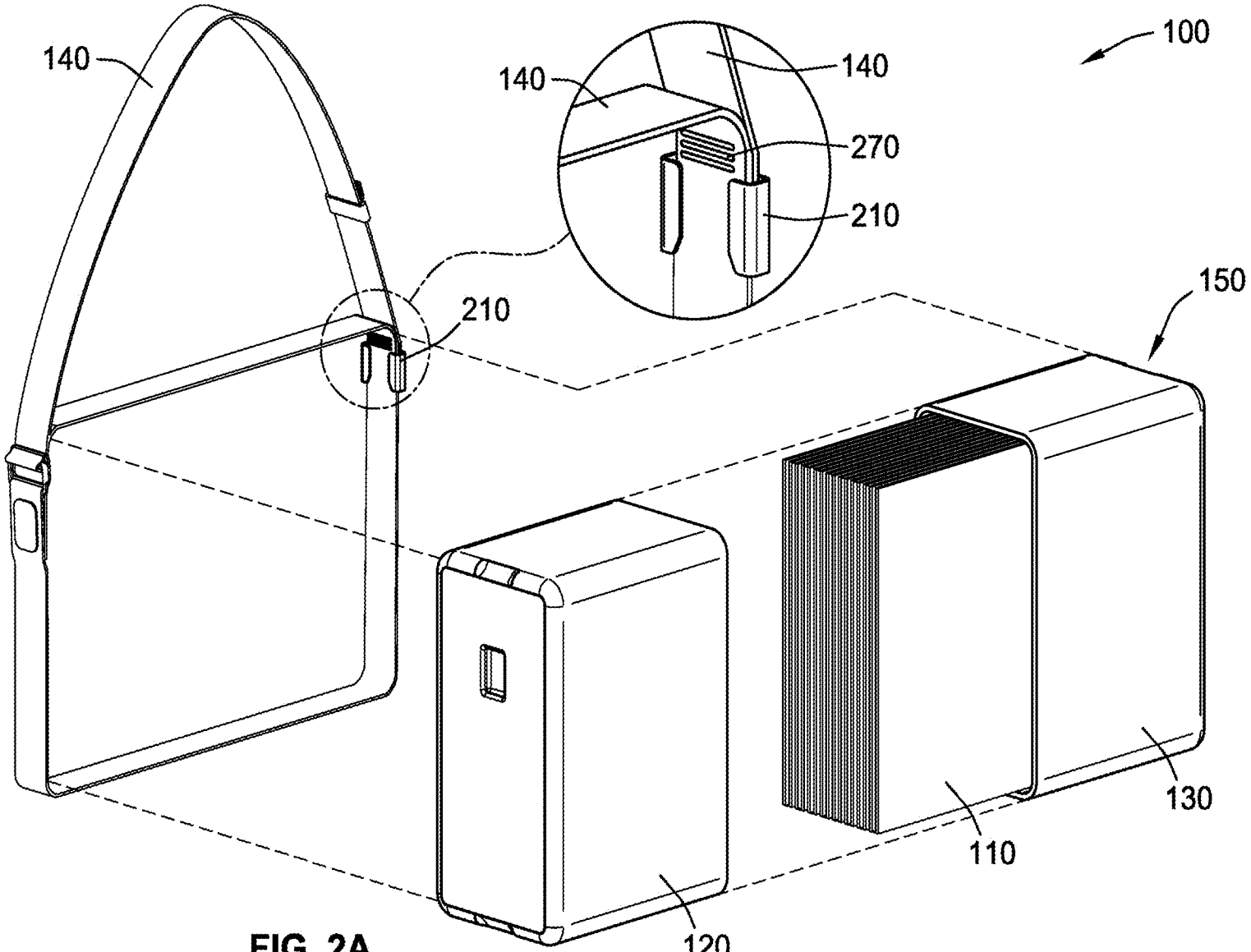
FIG. 2A is an exploded view of the yoga equipment storage system in accordance with one or more embodiments.

Referring now to FIG. 2A, an exploded view of the yoga equipment system is illustrated showing the strap 140 with at least one buckle 210, the at least one buckle on a side of the first or second yoga block 120 or 130. In FIG. 2A, yoga equipment system blocks 150 are shown separated from the strap 140 to illustrate one or more embodiments in which the strap 140 further includes at least one thermoplastic polyurethane strip 270 configured to prevent the sliding of the at least one buckle 210 past a predetermined area of the strap 140. In one embodiment, the thermoplastic polyurethane (TPA) strip 270 includes at least three strips to more securely prevent the sliding of the buckle 210.

Figure 2B:
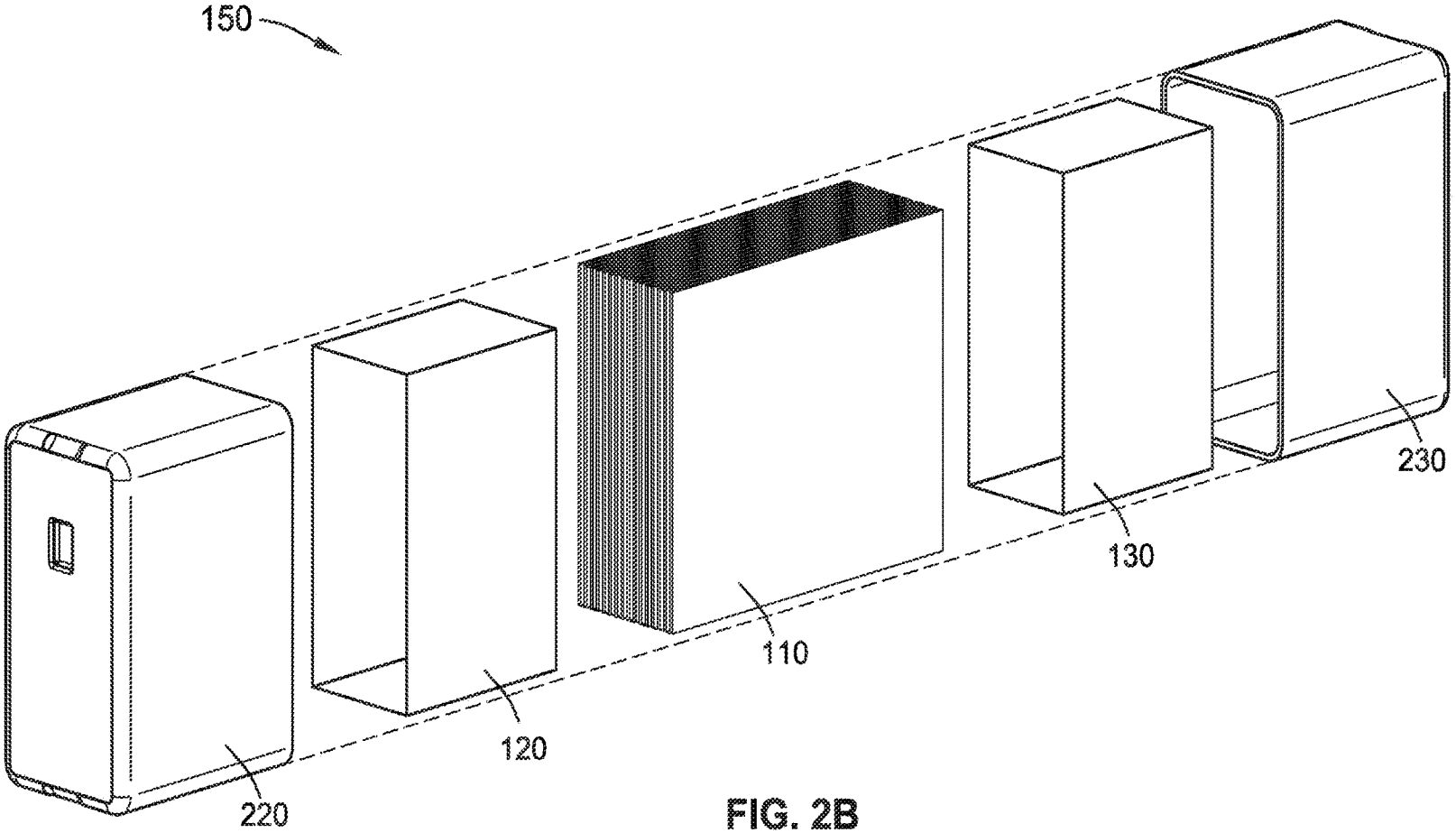
FIG. 2B is an exploded view of the yoga equipment storage system without a strap illustrating a yoga mat and yoga blocks in accordance with one or more embodiments.

Referring to FIG. 2B, in one or more embodiments, the first yoga block 120 and the second yoga block 130 can include a first plastic injection-molded outer sleeve 220 coupled to the first yoga block 120. Further, a second plastic injection-molded outer sleeve 230 can be coupled to the second yoga block 130. In other embodiments, one or more embodiments, each of the first plastic injection-molded outer sleeve 220 and the second plastic injection-molded outer sleeve 230 can include a plurality of magnets 240 embedded therein. In some embodiments, only one sleeve can include a plurality of magnets as shown in sleeve 220.

Figure 3A:
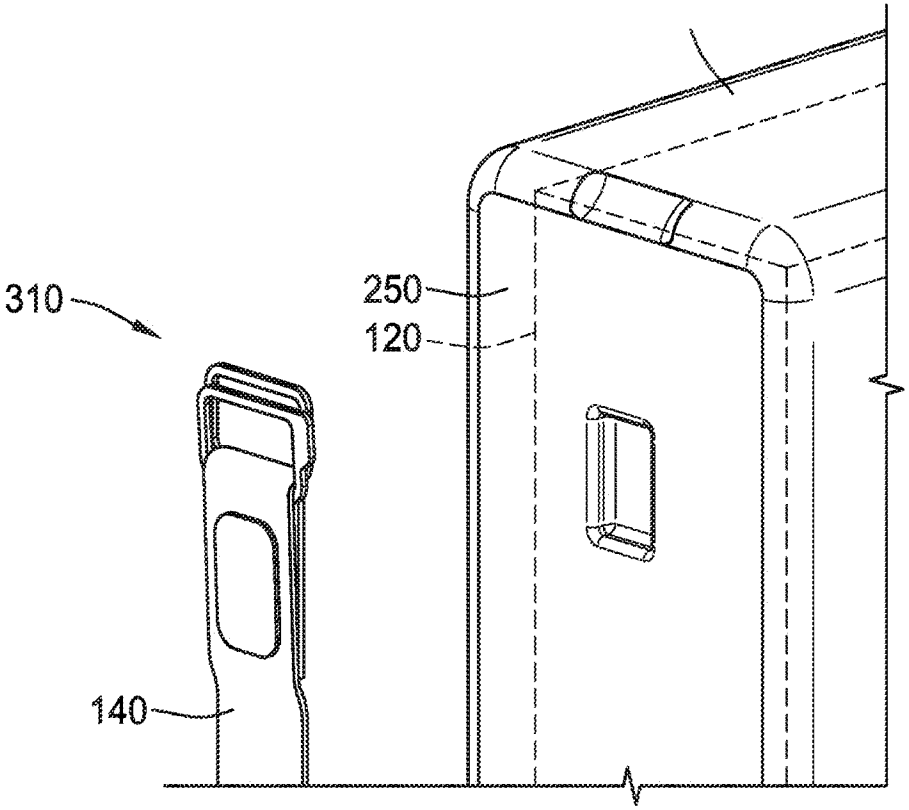
FIG. 3A is perspective view of a double-D link attachment to a strap and a side portion of the yoga equipment storage system in accordance with one or more embodiments.

Referring now to FIG. 3A, in one or more embodiments, the strap 140 further includes a double D-shaped ring 310 at a first end of the strap 140 to enable a second end of the strap 140 to secure a combination of the first yoga block 120 and the second yoga block 130 and the accordion-folded yoga mat 110. FIG. 3A illustrates a perspective view of a strap 140 coupled to a double-D-ring 310 and a side of yoga block 120 is shown including a first plastic injection-molded outer sleeve 220 and a first polyurethane foam outer cap 250 coupled to the first plastic injection-molded outer sleeve 220.

Figure 3B:
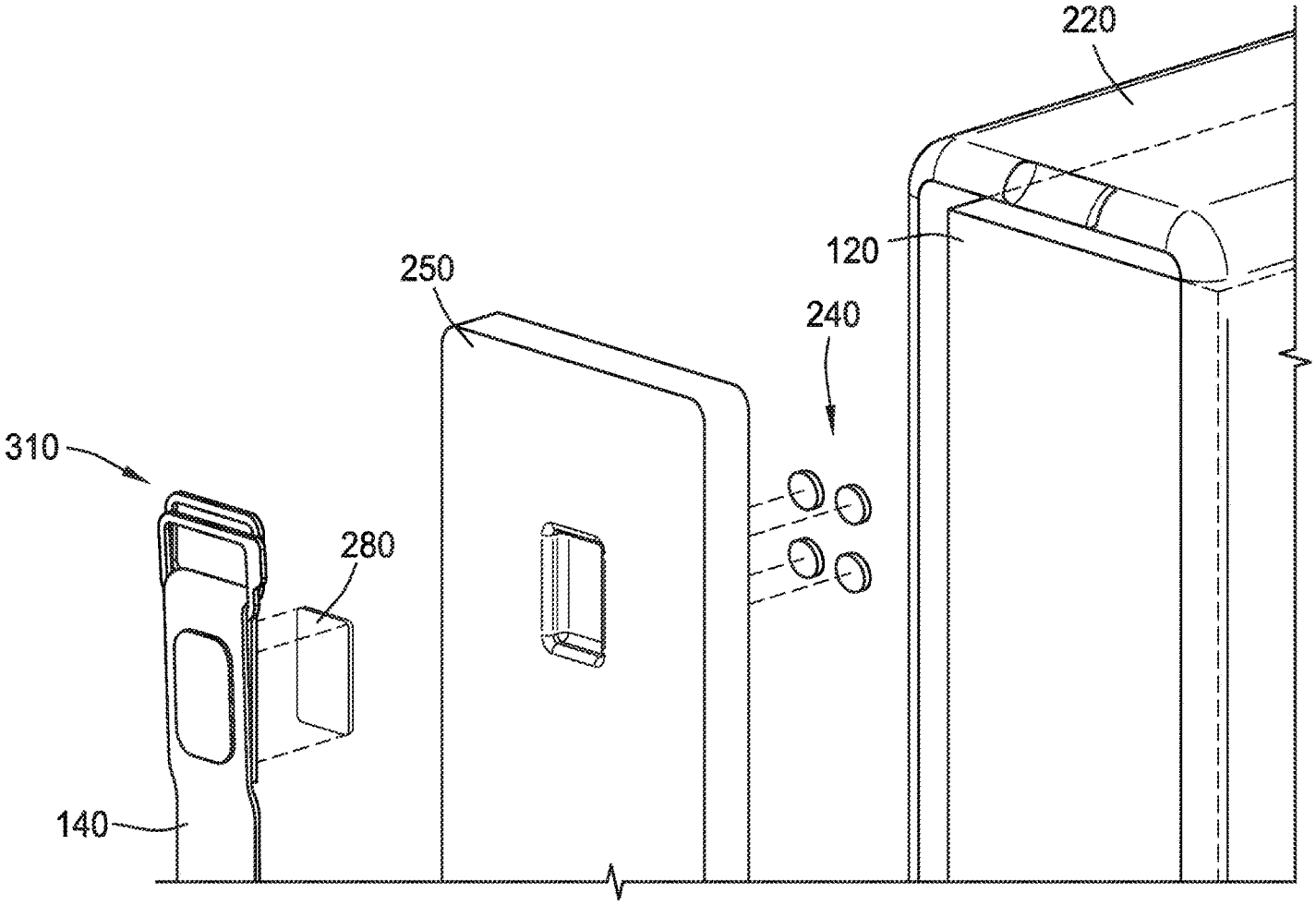
FIG. 3B is an exploded view of the double-D link attachment to a strap and a side portion of the yoga equipment storage system in accordance with one or more embodiments.
Figure 4:
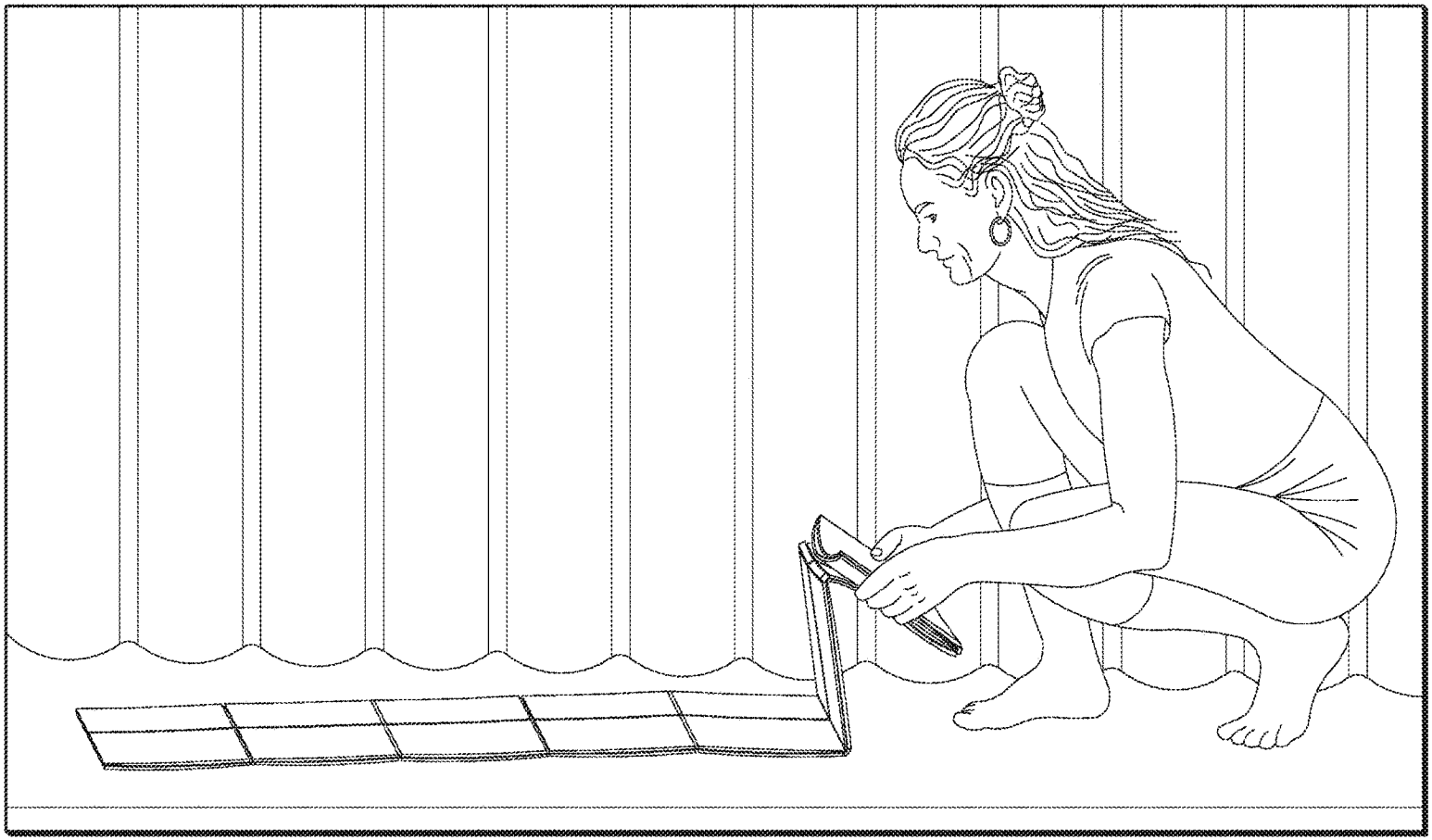
FIG. 4 is an environmental view of the yoga mat of the yoga equipment storage system in accordance with an embodiment.

Referring now to FIG. 3B, an exploded view of the double-D link attachment to a strap and a side portion of the yoga equipment storage system in accordance with one or more embodiments is shown, illustrating an embodiment with plurality of magnets 240 configured to be four magnets of sufficient strength to magnetically couple the strap 140 to yoga blocks 120 and 130 via metal plate 280.

In one embodiment, the first polyurethane foam outer cap 250 coupled to the first plastic injection-molded outer sleeve 220.

Similarly, a second polyurethane foam outer cap can be coupled to the second plastic injection-molded outer sleeve 230. In one embodiment, either or both the first second polyurethane foam outer cap 250 or the second polyurethane foam outer cap identify a location of the plurality of magnets 240.

In one or more embodiments, the first yoga block 120 and the second yoga block 130 include ethylene-vinyl acetate (EVA). Similarly, in one or more embodiments, the first and second polyurethane foam outer caps 250 and 260, respectively include ethylene-vinyl acetate (EVA).

As shown in FIG. 3B, in one or more embodiments, the strap 140 includes at least one metal plate 280 configured to correspond to at least one of the pluralities of magnets 240 embedded on the first plastic injection-molded outer sleeve 220 and/or the second plastic injection-molded outer sleeve 230.

In one or more embodiments, the at least one metal plate 280 is comprised of steel. In other embodiments, the metal plate 280 can be a combination of steel and other metals, such as iron or a to provide sufficient magnetic strength when coupled to the plurality of magnets 240.

Referring to FIGS. 4-7, the accordion-folded yoga mat is illustrated outside of the yoga equipment system blocks 150.

In one or more embodiments, the yoga mat 110 is a standard sized mat of 68 inches, and in other embodiments, the mat 110 can be 72, 74 or 84 inches. In one or more embodiments, the yoga mat 110 is 24 inches wide, and in other embodiments, the yoga mat is 30 or 36 inches wide, in accordance with system requirements.

In one or more embodiments, the thickness of yoga mat 110 is a function of the width and length so that yoga mat 110 can fit into the yoga blocks 120, 130 and be a compact, efficient system. Thus, in some embodiments, yoga mat 110 can be sized to be 1/16-inch thick, 1/8-inch thick or 1/4-inch thick.

In one or more embodiments, yoga mat 110 is made from latex, natural rubber, and/or vinyl.

Figure 5:
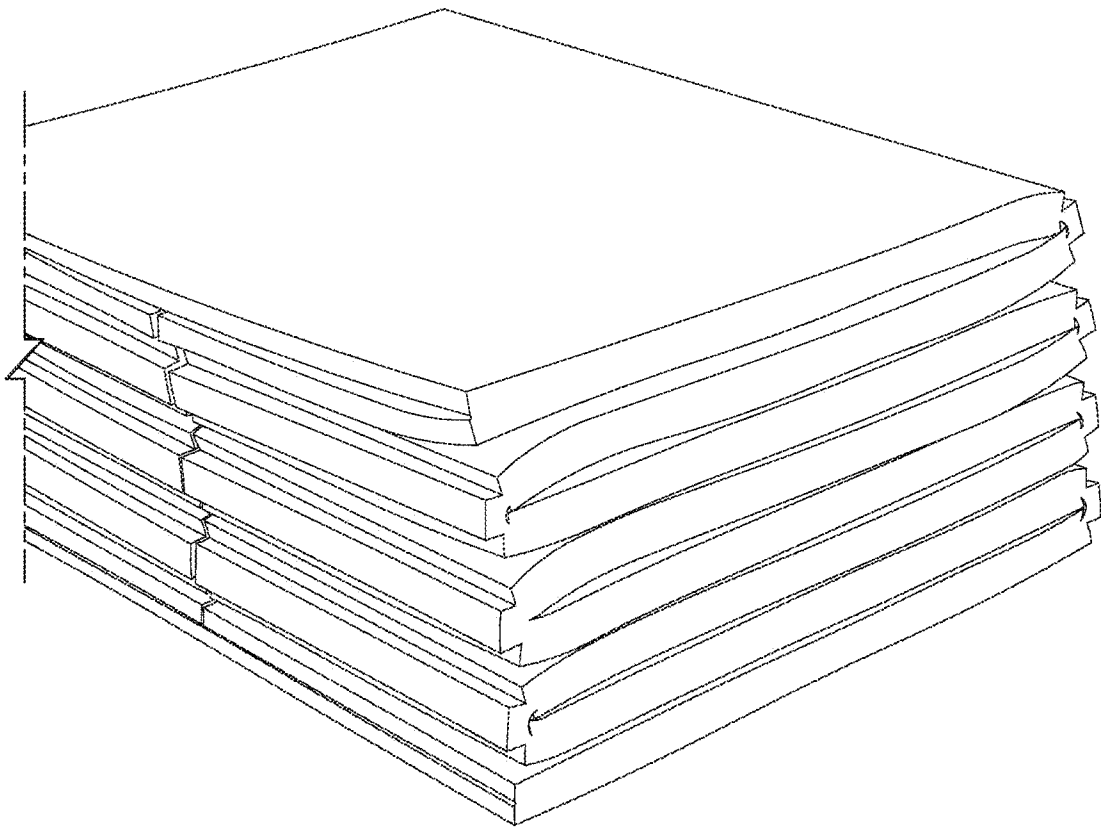
FIG. 5 is a perspective view of a folded yoga mat for insertion into the yoga equipment storage system.
Figure 6:
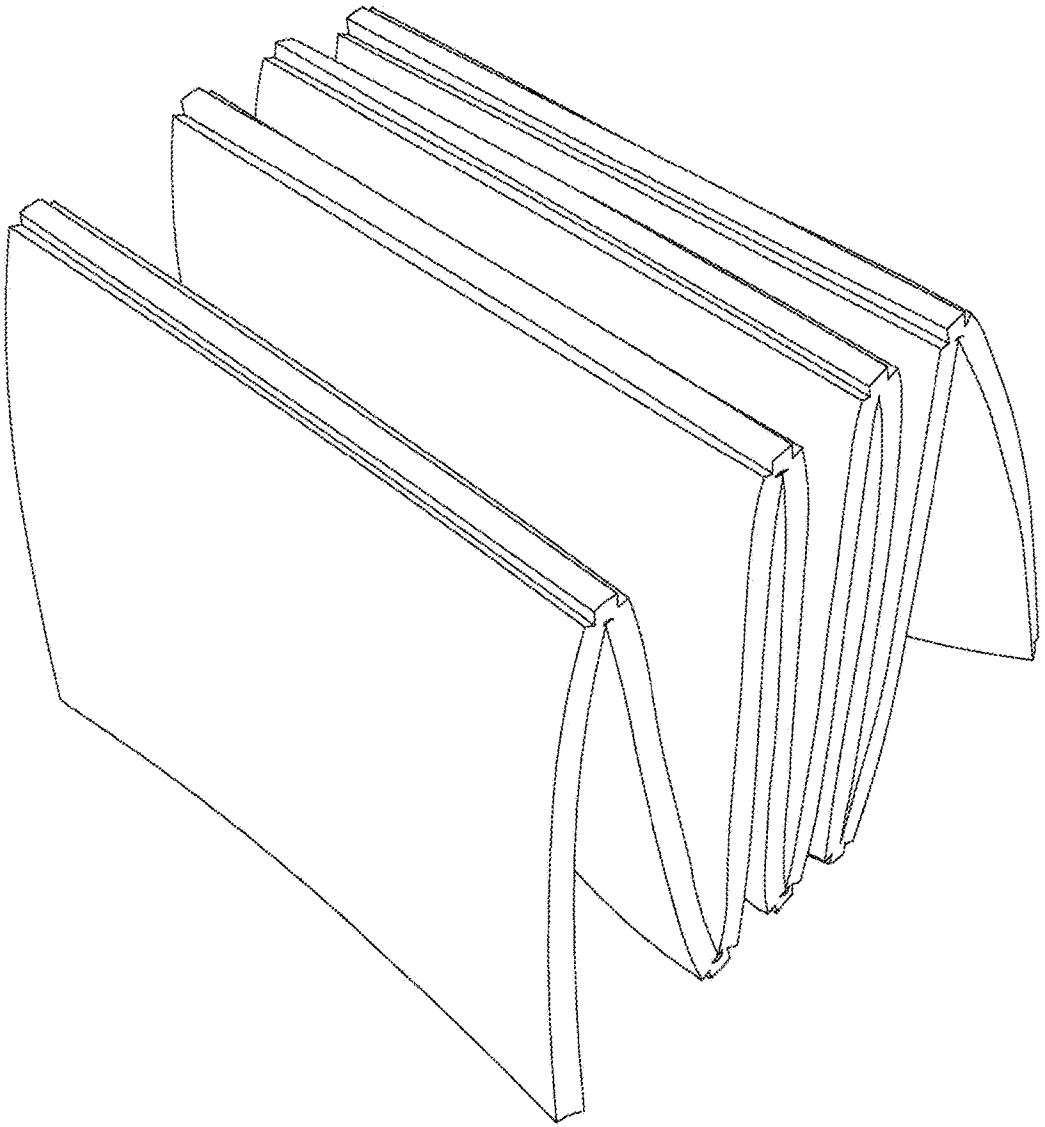
FIG. 6 is another perspective view of a partially-folded yoga mat for insertion into the yoga equipment storage system.
Figure 7:
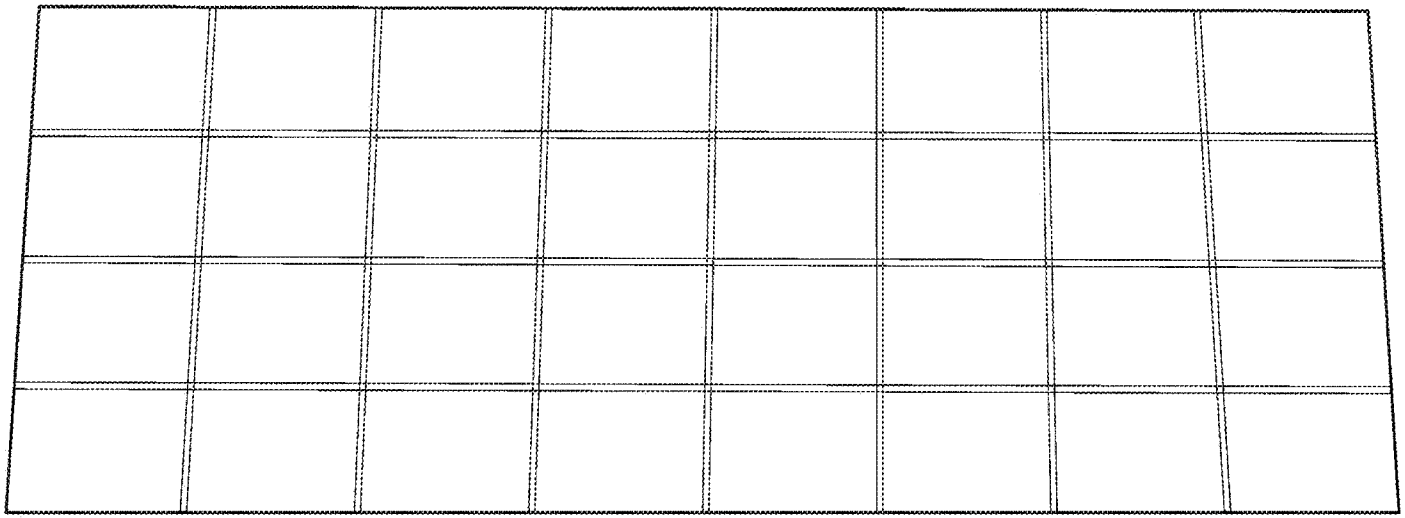
FIG. 7 is view of an unfolded-folded yoga mat for insertion into the yoga equipment storage system.

FIG. 5 illustrates a perspective view of a folded yoga mat for insertion into the yoga equipment storage system. As shown, the folds enable different combinations of heights. FIG. 6 is another perspective view of a partially-folded yoga mat for insertion into the yoga equipment storage system, illustrating that the yoga mat can be tri-folded lengthwise. FIG. 7 is view of an unfolded-folded yoga mat for insertion into the yoga equipment storage system, illustrating the multiple folds that are possible with the yoga mat 110.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A system for personal yoga equipment storage comprising:

a yoga mat folded by a first length, at least a first width, and accordion folded;

a first yoga block configured to enclose a first part of the accordion-folded yoga mat;

a second yoga block configured to enclose a second part of the accordion-folded yoga mat; and a strap configured to wrap the enclosed accordion-folded yoga mat by surrounding a perimeter of the first and second yoga blocks and conceal the accordion-folded yoga mat.

2. The system of claim 1, wherein the strap further comprises:

at least one buckle, the at least one buckle on a side of the first or second yoga block.

3. The system of claim 1, wherein the first yoga block and the second yoga block include:

a first plastic injection-molded outer sleeve coupled to the first yoga block; and a second plastic injection-molded outer sleeve coupled to the second yoga block, wherein each of the first plastic injection-molded outer sleeve and the second plastic injection-molded outer sleeves include a plurality of magnets embedded therein; and a first polyurethane foam outer cap coupled to the first plastic injection-molded outer sleeve; and a second polyurethane foam outer cap coupled to the second plastic injection- molded outer sleeve, wherein each of the first and second polyurethane foam outer caps identify a location of the plurality of magnets.

4. The system of claim 3 wherein the first yoga block and the second yoga block are comprised of ethylene-vinyl acetate (EVA).

5. The system of claim 3 wherein the first and second polyurethane foam outer caps are comprised of ethylene-vinyl acetate (EVA).

6. The system of claim 2 wherein the strap further comprises:

at least one thermoplastic polyurethane strip configured to prevent the sliding of the at least one buckle past a predetermined area of the strap.

7. The system of claim 3 wherein the strap further comprises:

at least one metal plate configured to correspond to at least one of a plurality of magnets embedded on the first plastic injection-molded outer sleeve and the second plastic injection-molded outer sleeve.

8. The system of claim 7, wherein the at least one metal plate is comprised of steel.

9. The system of claim 3 wherein the strap further comprises a double D-shaped ring at a first end of the strap to enable a second end of the strap to secure a combination of the first yoga block and the second yoga block and the accordion- folded yoga mat.

10. A method for storing personal yoga equipment, the method comprising: folding a yoga mat lengthwise at least once to reduce a width of the yoga mat; accordion-folding the reduced-width yoga mat;

enclosing a first part of the accordion-folded yoga mat with a first yoga block;

enclosing a second part of the accordion-folded yoga mat with a second yoga block; and surrounding a perimeter of the first and second yoga blocks with a strap configured to wrap and conceal the enclosed accordion-folded yoga mat.

11. The method of claim 10, wherein the strap further comprises:

at least one buckle, the at least one buckle disposed on a side of the first or second yoga block.

12. The method of claim 10, wherein the first yoga block and the second yoga block include:

a first plastic injection-molded outer sleeve coupled to the first yoga block; and a second plastic injection-molded outer sleeve coupled to the second yoga block, wherein each of the first plastic injection-molded outer sleeve and the second plastic injection-molded outer sleeves include a plurality of magnets embedded therein; and a first polyurethane foam outer cap coupled to the first plastic injection-molded outer sleeve; and a second polyurethane foam outer cap coupled to the second plastic injection-molded outer sleeve, wherein each of the first and second polyurethane foam outer caps identify a location of the plurality of magnets.

13. The method of claim 12 wherein the first yoga block and the second yoga block are comprised of ethylene-vinyl acetate (EVA).

14. The method of claim 12 wherein the first and second polyurethane foam outer caps are comprised of ethylene-vinyl acetate (EVA).

15. The method of claim 11 wherein the strap further comprises:

at least one thermoplastic polyurethane strip configured to prevent the sliding of the at least one buckle past a predetermined area of the strap.

16. The method of claim 12 wherein the strap further comprises:

at least one metal plate configured to correspond to at least one of the pluralities of magnets embedded on the first plastic injection-molded outer sleeve and the second plastic injection-molded outer sleeve.

17. The method of claim 16, wherein the at least one metal plate is comprised of steel.

18. The method of claim 17 wherein the strap further comprises a double D-shaped ring at a first end of the strap to enable a second end of the strap to secure a combination of the first yoga block and the second yoga block and the accordion- folded yoga mat.

19. The method of claim 18 wherein the at least one metal plate is disposed near the double D-shaped ring to enable a magnetic coupling of the at least one metal plate with one or more of the pluralities of magnets embedded on the first plastic injection-molded outer sleeve and the second plastic injection-molded outer sleeve.

* * * * *